United States Patent [19]

Arthur

[11] Patent Number: 4,690,444

[45] Date of Patent: Sep. 1, 1987

[54] SECURITY SEAL WITH RUPTURABLE WALL

[75] Inventor: Frank H. Arthur, Chelsfield Village, United Kingdom

[73] Assignee: Envopak Group Limited, Kent, England

[21] Appl. No.: 833,020

[22] Filed: Feb. 26, 1986

[30] Foreign Application Priority Data

Mar. 11, 1985 [GB] United Kingdom ..... 8506229

[51] Int. Cl.[4] ..... E05B 39/02

[52] U.S. Cl. ..... 292/324; 206/1.5; 292/331

[58] Field of Search ..... 24/662, 671, 678, 629, 24/652; 292/331, 324, 323, 318–326, 327–330; 70/422, 432, 439–441; 206/1.5; 411/8

[56] References Cited

U.S. PATENT DOCUMENTS

| | | | |
|---|---|---|---|
| 641,785 | 1/1900 | MacCormac | 292/322 |
| 1,112,123 | 9/1914 | Dow | 292/324 |
| 1,320,832 | 11/1919 | Bourque | 24/671 |
| 1,433,793 | 10/1922 | Carr | 24/662 |
| 1,496,885 | 6/1924 | Jones . | |
| 2,343,564 | 3/1944 | Mackey . | |
| 2,374,898 | 5/1945 | Rossiter | 292/327 |
| 2,869,911 | 1/1959 | Dickey et al. | 292/324 |
| 2,895,199 | 7/1959 | Jones | 24/662 X |
| 4,006,471 | 2/1977 | Pappas | 70/432 X |
| 4,093,287 | 6/1978 | Moore . | |
| 4,118,057 | 10/1978 | Ryan | 70/440 X |
| 4,295,761 | 10/1981 | Hansen | 411/8 X |
| 4,616,953 | 10/1986 | Gomes | 24/662 X |

FOREIGN PATENT DOCUMENTS

| | | | |
|---|---|---|---|
| 813487 | 2/1937 | France | 24/671 |
| 62569 | 10/1912 | Switzerland | 24/662 |
| 621404 | 4/1949 | United Kingdom | 24/662 |

*Primary Examiner*—Robert L. Wolfe
*Assistant Examiner*—Lloyd A. Gall
*Attorney, Agent, or Firm*—McAulay, Fields, Fisher, Goldstein & Nissen

[57] ABSTRACT

The invention relates to a security seal comprising a flexible strip (7), a locking box (1) attached to a first end of the strip, and a free second end of the strip being insertable through an entry slot (4) in the locking box for non-detachable locking therein. An indicating member (13) is arranged inside the box adjacent a rupturable wall (5) thereof so that, when locking of the free end of the strip is effected, the indicating member is caused to rupture the wall and thereby provide visible evidence of locking.

9 Claims, 9 Drawing Figures

SECURITY SEAL WITH RUPTURABLE WALL

BACKGROUND OF THE INVENTION

1. Field of the Invention

This invention relates to a security seal. Such seals are used to maintain the security of goods in transit, in that any attempt to open the seal by unauthorised personnel should leave visible evidence of tampering.

2. Description of the Prior Art

The invention is particularly concerned with seals of the kind known as strip seals. These comprise a flexible strip, one end of which is fixed inside a locking box or chamber. In use, the free end of the strip is bent back and inserted through an entry slot in the locking box for non-detachable locking therein. Strip seals can be subdivided into two main categories: ball strip seals and flat strip seals, both of these terms referring to the shape of the locking box.

In ball strip seals, the portion of the first end of the strip inside the ball-shaped locking box is bent back upon itself to form a channel for receiving the free end of the strip. In the locked position, holes in this channel section and in the free end of the strip are in register and locking is effected by one or more, usually two, spring steel circlips(circular clips) which pass through the holes. The circlips have free ends which, in the unlocked position, are resiliently spaced apart by the outer faces of the channel section backward (with reference to the direction of insertion of the free end of the strip) of the holes in the channel. As the free end of the strip is inserted, the leading edge thereof urges the circlips forward until, when all the holes are in register, the free ends of the circlips spring into the holes to effect locking. The dimensions of the holes are chosen so that there is a certain degree of free play of the free end of the strip in the locked position. This feature is utilized to provide visible evidence that the seal is locked. Opposite the entry slot in the locking box there is an exit slot and, in the locked position, it is possible to push the free end of the strip forward so that it partly protrudes from the exit slot, showing that the seal is locked. Once the seal is locked as described above, it is no longer possible to open it without breaking open the locking box or cutting the flexible strip, and in both cases there will be clear evidence of tampering. Usually, the strip is marked with identification letters and/or numbers to make each seal individually identifiable.

In flat strip seals, the end of the strip fixed inside the locking box is bent back upon itself and formed into a catch (rather like a fish hook). The free end of the strip has a hole in it so that, when it is inserted into the locking box, it passes over the catch and the latter springs back at an angle at 45°-60° to engage with the hole. Subsequent withdrawal of the end of the strip is thereby impeded.

In operational conditions, particularly outside in adverse weather conditions, the method described above for checking that a ball seal is locked, i.e. causing the free end of the strip to protrude from the locking box, can be difficult to carry out reliably in practice. Another recommended test to ensure locking, and which applies both to ball seals and to flat seals, is the so-called "tug" test which is to circumvent anyone merely placing the free end of the strip into the locking box to give the appearance that the seal is locked. In this test, the strength of the circlip mechanism in ball seals is far superior to that of the catch mechanism in flat seals.

A serious weakness both of ball seals and of flat seals is the vulnerability of the locking box itself. The locking box in ball seals usually comprises a ball housing of two substantially hemispherical parts that are swaged together creating a seam of varying strength of vulnerability. In some designs, a separate additional piece of material is crimped over the overlapping portions. Various illicit methods of opening the locking box and then re-sealing it have been developed. For example, the box may be cut open with a very fine saw, thereby giving access to the interior so that the circlips can be opened. The mechanism can then be re-set and the locking box re-sealed with glue. The end result can be very difficult to detect, especially under operational conditions.

An object of the present invention is to overcome the problems outlined above in connection with ball seals, while preferably maintaining the superior strength of the ball seal in comparison with flat seals. In particular, we have sought to provide an improved means for indicating that the seal is in the locked position, and to provide improved security for the locking box itself. Although the invention is particularly useful in connection with ball strip seals, it also has general applicability to strip seals.

SUMMARY OF THE INVENTION

The present invention provides a security seal comprising a flexible strip, a locking box attached to a first end of the strip, and a free, second end of the strip being insertable through an entry slot in the locking box for non-detachable locking therein, characterised in that an indicating member is arranged inside the box adjacent a rupturable wall thereof so that, when locking of the free end of ths strip is effected, the indicating member is caused to rupture the wall and thereby provide visible evidence of locking.

The locking box preferably comprises a plastics inner lining substantially convered by an outer metal skin, such that there is a portion of one end wall having uncovered plastics material and having therein an area of weakness which is rupturable by the indicating member.

More preferably, the locking box is substantially cylindrical with rounded edges, the outer metal skin covers the sides and is rolled over at both ends of the box leaving an uncovered plastics portion at the center of each end wall, one end wall having an entry slot for the strip and the opposite end wall having an area of weakness rupturable by the indicating member.

BRIEF DESCRIPTION OF THE DRAWINGS

Reference is now made to the accompanying drawings, in which.

DESCRIPTION OF THE PREFERRED EMBODIMENTS

Figures 1, 2:
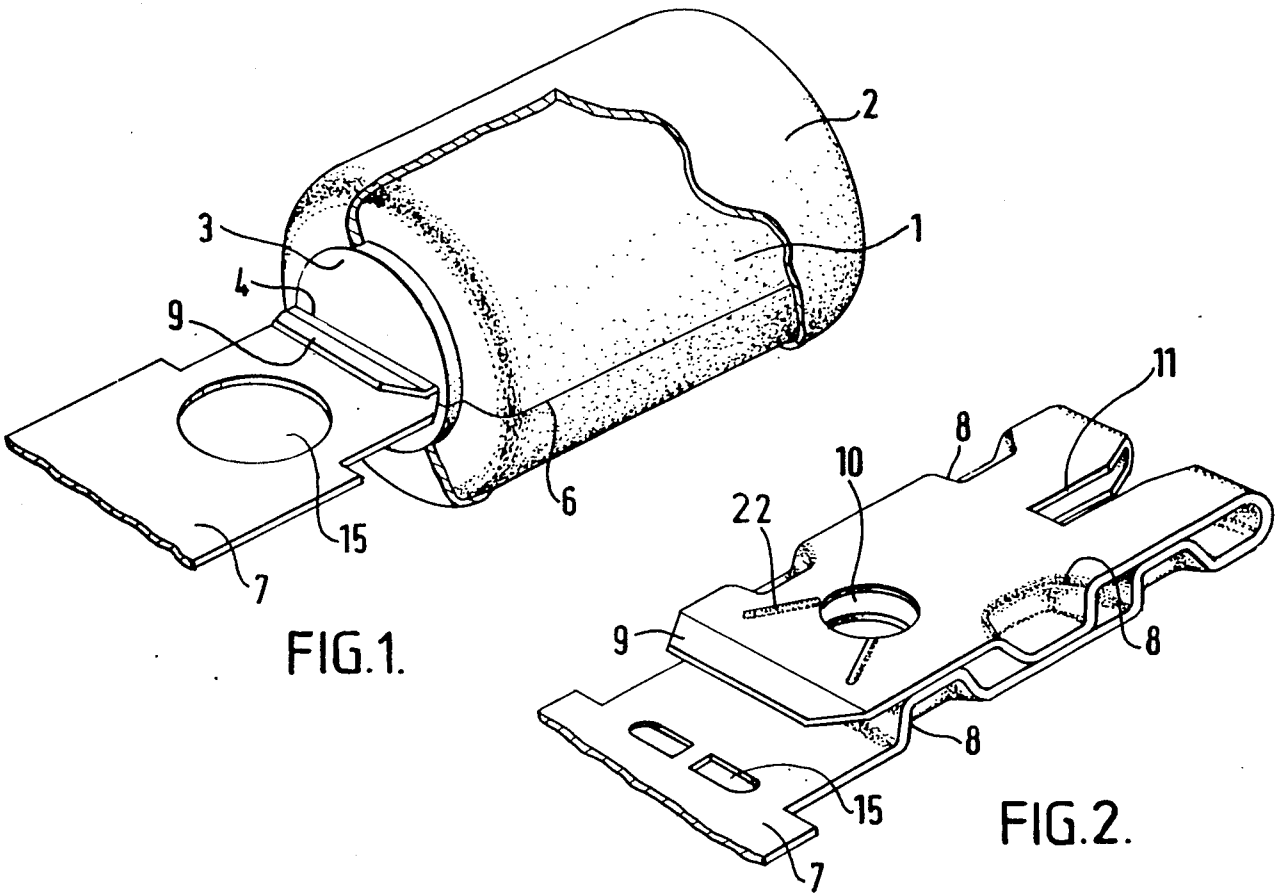
FIG. 1 is an external view of the locking box attached to the first end of the flexible strip, in a security seal according to a preferred embodiment of the invention.
FIG. 2 shows the bent back portion of the first end of the strip which is fixed inside the locking box.

The locking box is substantially cylindrical with rounded corners and comprises an inner, hollow plastics capsule 1 (shown in cut-away portion of FIG. 1) and an outer seamless metal skin 2. The metal skin covers the sides and is rolled over or spun at both ends of the box, leaving an exposed central section of a plastics end wall 3 with an entry slot 4, and an exposed central section of a plastics end wall 5 at the opposite end of the locking box.

For ease of construction, the inner plastics capsule 1 is made in two halves separated by a longitudinal joint 6. The flexible strip 7 is of metal and the first end, fixed inside the locking box, is bent back upon itself as shown in FIG. 2. Profiled configurations 8 are formed in this bent back portion and engage with corresponding configurations (not shown) inside the plastics capsule, to locate and fix the bent back portion of the strip inside the locking box. The bent back portion defines a longitudinally extending channel into which the free end of the strip can be inserted. Entry of the free end of the strip into this channel is assisted by a shaped flap 9 at the tip of the bent back portion, the flap being external of the locking box and the bent back portion being substantially within the locking box and protruding from the entry slot 4.

Figure 4:
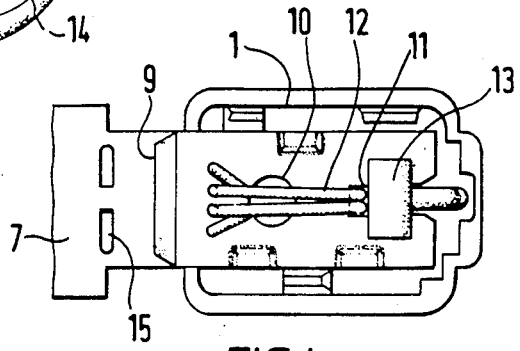
FIG. 4 is an internal view of the locking box in the unlocked positon.
Figure 6:
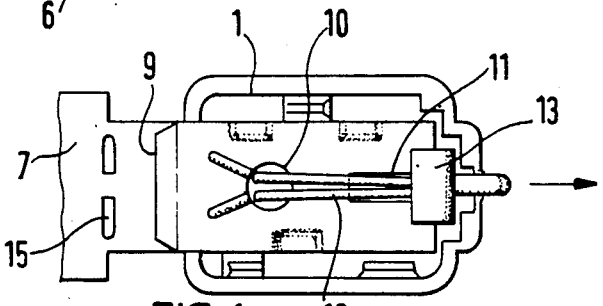
FIG. 6 is an internal view corresponding to FIG. 4, but in the locked position.
Figure 7:
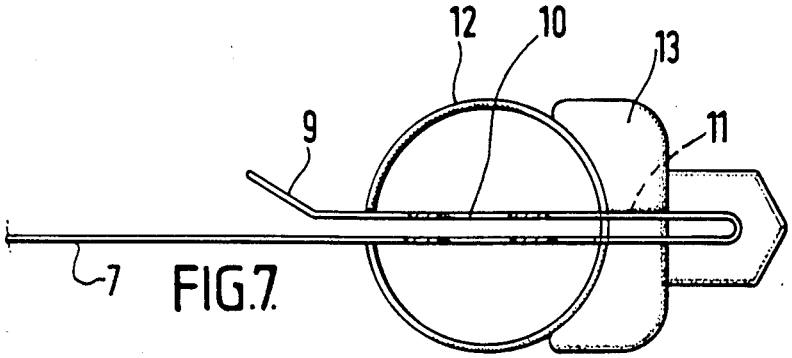
FIG. 7 is a view of the locking mechanism inside the locking box in the unlocked position.
Figure 8:
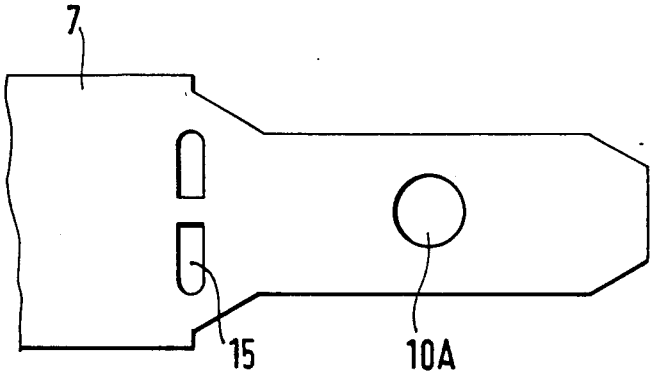
FIG. 8 shows the design of the free end of the strip.
Figure 9:
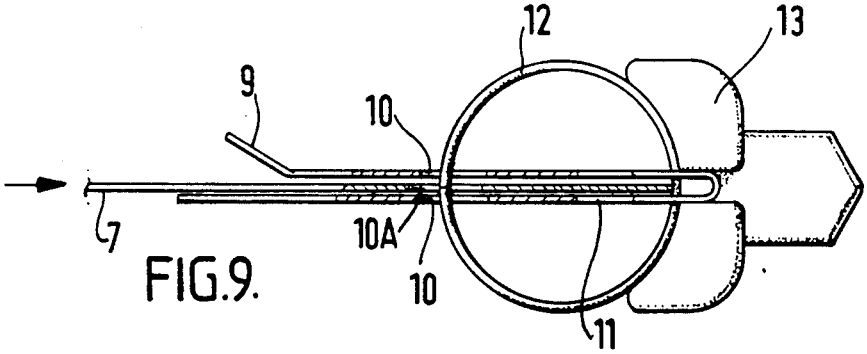
FIG. 9 is a view corresponding to FIG. 7 but in the locked position.

Locking of the seal is achieved by a modification of the ball seal locking mechanism. A pair of circular holes 10 in register with each other is arranged in the folded back portion. Forward of this pair of holes there is a longitudinally extending cut-out section 11. A pair of spring steel circlips 12 passes through the cut-out 11 and, in the unlocked position, the ends of the circlips are resiliently spaced apart by the outer faces of the bent back portion, as shown in FIGS. 4 and 7. The free end of the flexible strip has a circular hole 10A of the same dimensions as the pair of holes 10. In order to achieve locking, the free end of the strip is inserted into the entry slot 4 of the locking box, and into the channel defined by the folded back portion of the fixed end of the strip. In this process, the leading edge of the free end passes through the channel, past the pair of holes 10, until it reaches the cutout 11, whereupon it abuts against the circlips 12. Further insertion into the locking box causes the leading edge of the free end of the strip to urge the circlips forwards in the direction of the arrows in FIGS. 6 and 9. The opened ends of the circlips then pass over the outer faces of the bent back portion towards the pair of holes 10, being guided by converging ribs 22 on the outer faces of the bent back portion. When the opened ends of the circlips reach the pair of holes 10 they spring into the holes and the circlips are thus resiliently closed. The position of the hole in the free end of the strip is selected so that, at this point, the hole 10A in the free end of the strip is in registry with the pair of holes 10. Thus, the "sprung" circlips lock the free end of the strip together with the bent back portion as shown in FIGS. 6 and 9.

Figure 3:
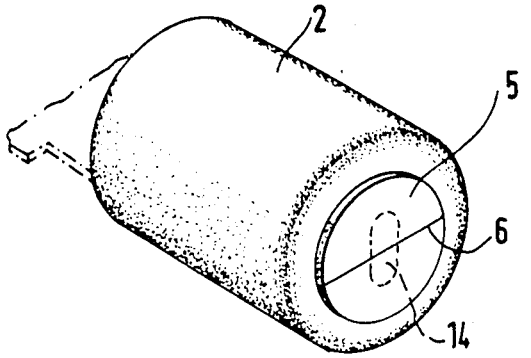
FIG. 3 is a perspective view of the locking box showing the exposed, rupturable plastics end wall.
Figure 5:
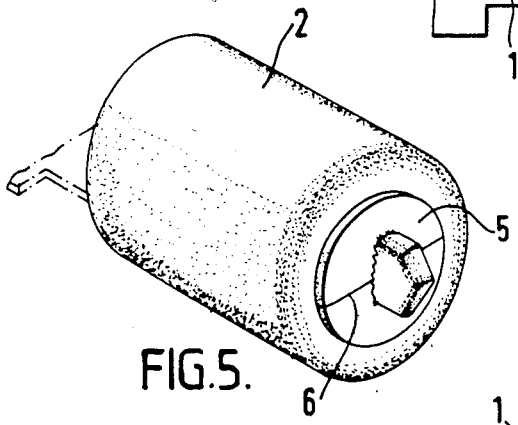
FIG. 5 is a perspective view corresponding to FIG. 3, but in the locked position in which the indicating member has ruptured the plastics end wall.

Evidence of locking is obtained by means of an indicator member 13 which is arranged inside the locking box adjacent the plastics end wall 5. The indicating member has a base portion and a tip portion, the tip portion being pointed and, in the unlocked position (FIG. 4), adjacent the inside of a thin section 14 (shown by broken lines in FIG. 3) of the wall 5. The base portion of the indicating member 13 has a longitudinally extending cut-out so that it can be positioned astride the bent back portion and abutting the ends of the circlips 12 (FIG. 7). When locking takes place, the circlips are urged forward by the leading edge of the free end of the strip, and the circlips in turn urge the indicating member 13 forward. In the course of this movement, the tip portion of the indicating member pierces the weakened section 14 of the end wall 5 and protrudes from the end wall as shown in FIGS. 5 and 6. The indicating member 13 is of plastics material, and is of a color which contrasts with the color of the end wall 5, so that the protruding tip is readily visible. The holes 10 in the bent back portion and the hole 10A in the free end of the strip are of relatively small dimensions compared with conventional ball seals, so that there is only a relatively small amount of longitudinal free play of the free end of the strip in the locked position. Once the tip of the indicating member has pierced the rupturable wall, there is a permanent indication that the seal is locked, and because of the small amount of free play and the constraint imposed by the position of the "sprung" circlips, the tip cannot be pushed back through the ruptured wall.

When the seal is to be opened by authorised personnel, the strip can simply be cut. However, this requires a secondary cutting implement or tool, whereas in a preferred embodiment the strip has a transverse line of weakness to facilitate manual breakage. More preferably, the flexible strip has two such lines of weakness in the form of perforations 15 arranged near the two ends, so that the two lines of perforations are outside the locking box and are in registry in the locked position, thereby providing an additional indication of locking. The perforations 15 may, for example, consist of a single circular hole (as shown in FIG. 1) or a pair of elongated holes (as shown in the other Figures).

The seal which has been described above has a number of advantageous features in comparison to conventional ball seals. The indicating member of contrasting color, when it has burst through the end wall of the locking box, provides a readily visible and tactile indication of locking. This indication is not dependent upon manipulation of the free end of the strip as in conventional ball seals. It should be noted that such manipulation can only be done manually, and becomes virtually impossible under certain operational conditions, e.g. when the seal is on a container which is out of reach of an inspector. In such cases, visual examination is the only viable means of checking whether the seal is properly sealed.

Furthermore, once the end wall has been ruptured by the indicating member, this cannot be disguised. Once the indicating member has emerged, it cannot be pressed back into the locking box after the seal has been locked. This is because of the restricted amount of free play between the sprung wire circlips and the holes in the strip. In view of the longitudinal cut-out 11 in the bent back portion, the planes of the circlips remain substantially parallel to the longitudinal axis of the strip in both the non-locked and locked positions.

The vulnerability of the locking box itself to unauthorised interference has been greatly reduced by means of the two part plastics and metal construction. The outer steel skin is seamless and, in manufacture, is rolled over or spun around the ends of the plastics capsule to leave the exposed central sections of the plastics end walls. The contrasting strengths of the materials used, hard steel over relatively soft plastics material, compounds the difficulty of deforming the rolled-over ends of the metal skin without damaging beyond repair the ends of the plastics chamber. In fact, unsealing the metal housing by attempting to bend back the turned-in metal end that curves over the contours of the plastic chamber is virtually impossible even under laboratory conditions. In manufacture, the metal skin is rolled over at the ends in a totally smooth manner, which greatly increases its inherent strength.

The outer metal skin of the locking box and the flexible strip will generally be of rust-resistant steel, but other materials, such as aluminium, brass, copper and painted steel, are also possible. As is usual in the security field, the strip will be marked with identification letters and numbers. The plastics chamber can be made of varying, which will be contrast with the color of the indicating member which emerges on locking. Such colors can be used as the basis of a secure color indentification system, since the color of the indicating member only becomes known when the seal has been locked.

The design of the internal area of the locking box, plus the position of the upsrung circlips, prevents illicit movement of the indicating member so that it ruptures the plastics membrane area while at the same time retaining the two circlips in an unsprung position. If this was possible it could make it visually appear that the seal had been properly sealed by merely bending the free end and placing it in the entry area of the chamber without touching and disengaging the circlips. Of course, this could be discovered if the tug test was then made, but in certain instances it would be very difficult to make this test and therefore the sight of the visual indicator is vital.

While it would be possible to insert a probe resembling the free end of the strip into the locking chamber thereby dislodging the circlips and forcing the indicating member through the plastics membrane, the configuration inside the chamber of this seal is different to other seals in that there is a lack of any awkward shaped pieces.

on to which the free end of the seal could be made to catch and to some degree give the illusion that the seal was properly sealed. This has been known to apply with other seals because of the nature of the internal construction within the locking chamber or box whereas with this new seal there are no crevices or awkwardly shaped areas that would help facilitate this manoeuver.

I claim:

1. A security seal of the type having internal means for non-detachable locking therein comprising a flexible strip, a locking box attached to a first end of the strip, and a free, second end of ths strip being insertable through an entry slot in the locking box for non-detachable locking therein, characterised in that an indicating member is arranged inside the box adjacent a rupturable wall thereof so that, when locking of the free end of the strip is effected, the indicating member is caused to rupture the wall and thereby provide visible evidence of locking.

2. A security seal according to claim 1, wherein the locking box compirses a plastics inner lining substantially covered by an outer metal skin such that there is an uncovered center only to each of two opposing plastics end walls, one end wall having therein an area of weakness which is rupturable by the indicating member.

3. A security seal according to claim 2, wherein the area of weakness is constituted by a thin plastics membrane.

4. A security seal according to claim 1, wherein the indicating member has a base portion and a tip portion, the base portion being adapted to engage with the free end of the strip so that, as the strip is inserted into the locking box, the indicating member is urged forward causing the tip portion to pierce the rupturable wall.

5. A security seal according to claim 1, wherein the first end of the flexible strip is fixed inside the locking box and has an end portion folded upon itself to define a channel within the locking box through which the free, second end of the strip can be inserted, and a pair of holes in registry in the folded portion; the free, second end of the strip has a hole which, in the locked position, is in register with the said pair of holes; and locking is effected by one or more circlips which pass through the holes, the ends of the circlip(s) being resiliently spaced apart, in the non-locked position, by the outer faces of the folded portion backward of the pair of holes (relative to the direction of insertion of the free end of the strip) whereby the leading edge of the free, second end of the strip pushes the circlip(s) forward as it is inserted into the locking box until, when all the holes are in registry, the ends of the circlip(s) spring into the holes and are resiliently closed to effect locking.

6. A security seal according to claim 5, wherein the folded end portion has a longitudinally extending cutout portion forward of the pair of holes and through which the or each circlip passes, to ensure that the plane of the circlip(s) remains substantially parallel to the longitudinal axis of the strip in both the non-locked and locked positions.

7. A security seal according to claim 1, wherein the indicating member and the rupturable wall are of contrasting colors.

8. Security seal according to claim 1, wherein the flexible strip has a transverse line of weakness to facilitate breakage.

9. A security seal according to claim 8, wherein the flexible strip has two such lines of weakness comprising perforations, arranged so that the two lines of weakness are in registry with each other in the locked position, thereby providing an additional indication of locking.

* * * * *